United States Patent [19]

Blum et al.

[11] Patent Number: 4,735,195

[45] **Date of Patent: * Apr. 5, 1988**

[54] DEVICE ENCOURAGING PERIODIC JOINT MOTION AND MUSCLE ACTIVITY

[76] Inventors: Alvin S. Blum, 2350 Del Mar Pl., Fort Lauderdale, Fla. 33301; James Dickey, Jr., 3018 N. Atlantic Blvd., Fort Lauderdale, Fla. 33308

[ * ] Notice: The portion of the term of this patent subsequent to Mar. 5, 2002 has been disclaimed.

[21] Appl. No.: 900,244

[22] Filed: Aug. 25, 1986

Related U.S. Application Data

[63] Continuation-in-part of Ser. No. 846,923, Apr. 1, 1986, abandoned, which is a continuation-in-part of Ser. No. 747,802, Jun. 24, 1985, abandoned.

[51] Int. Cl.[4] ..... A61H 1/02

[52] U.S. Cl. ..... 128/25 R; 128/25 B; 128/707; 272/96; 272/DIG. 5; 272/70

[58] Field of Search ..... 272/70, 93, 96, DIG. 5; 340/573; 128/25 R, 25 B, 382, 383, 707, 709, 733, 734, 779

[56] References Cited

U.S. PATENT DOCUMENTS

| | | | |
|---|---|---|---|
| 2,718,396 | 9/1955 | Lateau et al. | 272/900 |
| 3,791,375 | 2/1974 | Pfeiffer | 128/779 |
| 3,834,702 | 9/1974 | Bliss | 272/70 |
| 3,974,491 | 8/1976 | Sipe | 272/70 |
| 4,216,956 | 8/1980 | Yamamura et al. | 272/70 |
| 4,463,946 | 8/1984 | Wallace et al. | 272/DIG. 5 |
| 4,502,680 | 3/1985 | Blum et al. | 272/900 |

*Primary Examiner*—Richard J. Apley
*Assistant Examiner*—J. Welsh
*Attorney, Agent, or Firm*—Alvin S. Blum

[57] ABSTRACT

Electronic device which may be worn by a user while moving about. Senses muscle actions of lower leg by switch under foot and is capable of monitoring ankle motion. Signals to user when ankle flexing motion is not of sufficient amplitude or leg muscle action is not performed frequent enough to enhance the circulation of blood, which helps to prevent vascular stasis and dependent edema associated with prolong periods of sitting or standing without muscle activity. Signals to user when ankle flexing motion is not of sufficient amplitude or leg muscle action is not performed frequently enough to enhance the circulation of blood, which helps to prevent vascular stasis and dependent edema associated with prolonged periods of sitting or standing without muscle activity. One embodiment may be worn while standing or sitting in a vehicle. Other embodiments are adapted for monitoring the activity of other body joints to encourage adequate activity to prevent vascular stasis, edema and joint dysfunction such as in recovery from joint surgery.

27 Claims, 6 Drawing Sheets

FIG. 2
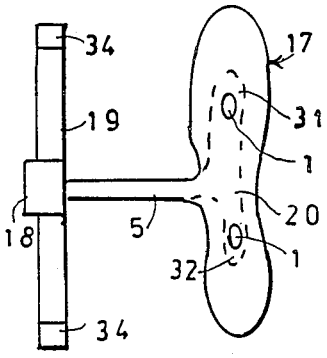
FIG. 1
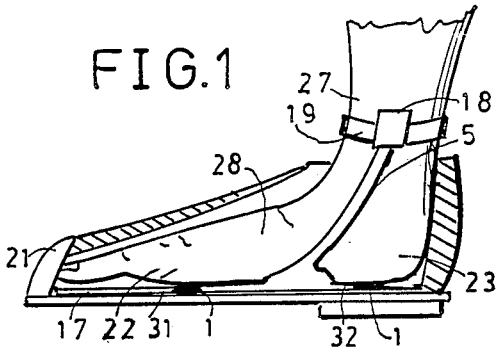
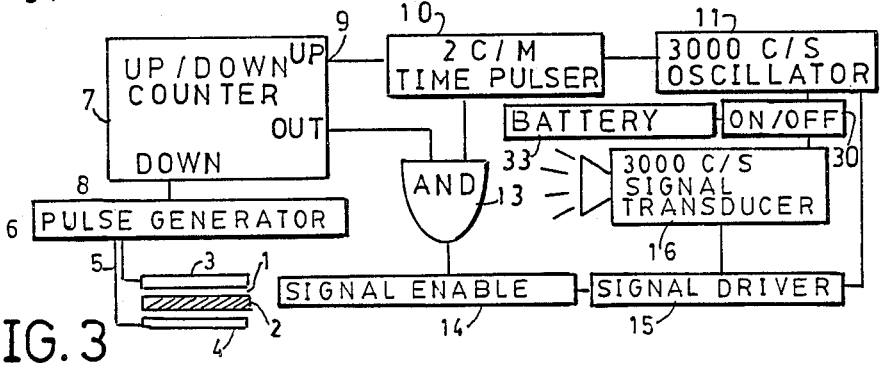
FIG. 3
FIG. 5
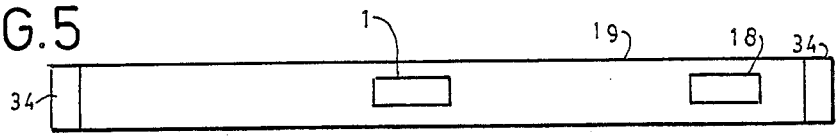
FIG. 6
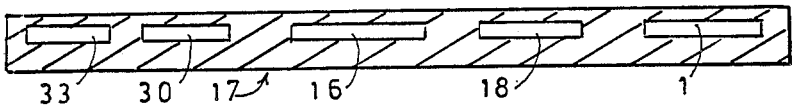
FIG. 8
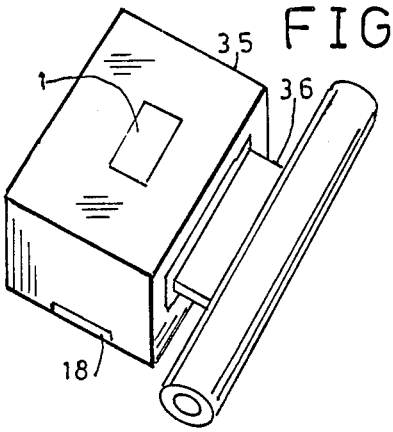
FIG. 4
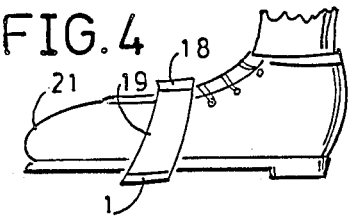
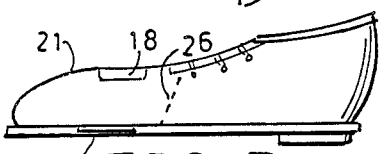
FIG. 7

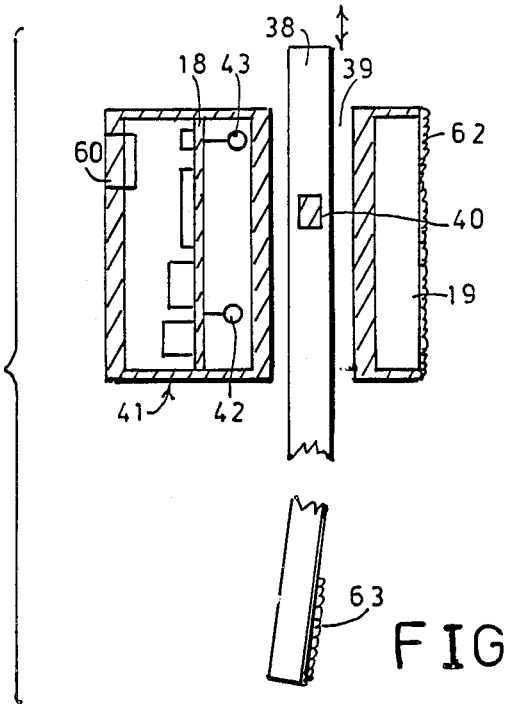
FIG. 11
FIG. 14
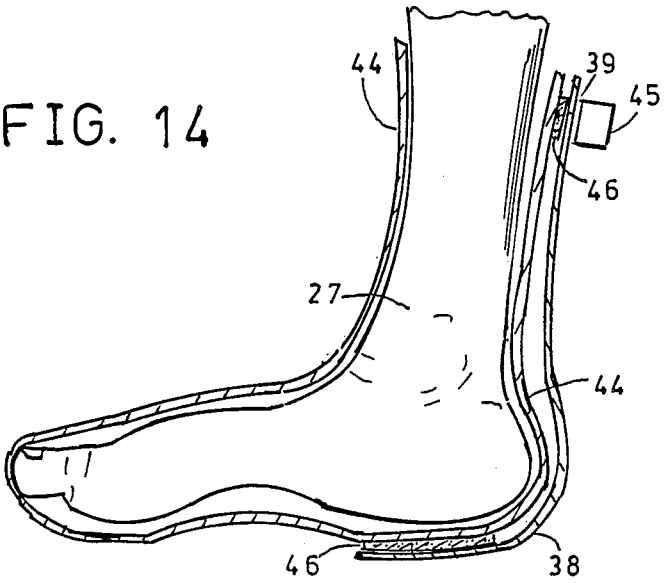

6804
IC1
POWER
SW1
4 CELLS
5V
R1
10K
470 mf
C1
RST
470 Ω
SW2
SECONDS BETWEEN STROKES
64
32
16
8
ALLOWABLE STROKES MISSED
8
4
2
DOUBLE SWITCHES ON
5V
R5
R6
R7
R8
R9
R10
R11
R12
Q2
470
R14
10K
R13
ALL 10K
PA0
PB7
PB6
PB5
PB4
PB3
PORT A
PORT B
PORT C
IMED
C2
INT
VCC
PGM NUM
TIMER
PC0
PC1
PC2
PC3
PB0
PB1
PB2
XTL
C4
30 PF
C3
4MHZ
2.2 K
R2
C5
R3
100K
REED SW1
CONTROL MAGNET
N
S
10K
R8
REED SW2
C6
TO COUNTER 74C 946
Q1
470K
R4
XDCR
5V

DEVICE ENCOURAGING PERIODIC JOINT MOTION AND MUSCLE ACTIVITY

This application is a continuation in part of Ser. No. 846,923 filed Apr. 1, 1986 which is a continuation in part of Ser. No. 747,802 filed June 24, 1985, the matter of which is hereby incorporated by reference, both applications now abandoned.

TECHNICAL FIELD

This invention relates to apparatus for preventing vascular stasis edema, and joint dysfunction by activity reminder mechanisms generally worn by the user that encourage periodic motion of a body joint.

BACKGROUND ART

Prior art including U.S. Pat. Nos. 3,022,071; 3,421,761; 3,525,522; 3,526,220; 3,741,540; 3,917,261; 4,111,416; 4,204,675 and 4,216,956 describe devices for exercising foot and leg muscles that have met with little acceptance and have not resolved the problem of vascular stasis. U.S. Pat. No. 4,502,680 relates to foot exercisers with pedals requiring a certain amplitude of ankle flexing to operate reminder mechanisms for overcoming the problems of vascular stasis encountered by subjects during prolonged sitting.

DISCLOSURE OF INVENTION

The present invention encourages sufficient periodic contraction and relaxation of the muscles of the lower leg to prevent vascular stasis by means of a device generally worn by the user. In contrast to floor mounted mechanisms of the prior art, the instant invention may be worn by the user without interfering with his activity. That permits its use by individuals who must stand for a prolonged interval without sufficient walking motions to overcome vascular pooling in the feet and legs. It may be advantageously employed by dentists, store clerks, surgeons and the like. It may also be used by seated subjects in circumstances wherein floor-mounted pedal mechanisms of the prior art would be awkward, such as airline and motor vehicle passengers and the like. It may be employed effectively to prevent postoperative complications and vascular stasis problems in a patient confined to bed and unable to move about normally. This device may thereby reduce the incidence of pulmonary embolism and thrombosis which are the major postoperative risk of surgery. The invention includes a switch mechanism to be worn in or on the shoe or sock or attached to the leg for sensing certain leg muscles actions and a tallying, timing and reminder device connected to the switch mechanism. This device requires that a certain number of leg muscle actions be performed in a certain time interval, as sensed by a switch or a plurality of switches. If the requisite number of actions is not sensed, the user is reminded by a signal.

These alternating muscle actions propel or pump blood from the limb to the heart. This function becomes especially important when the force of gravity reduces the circulation when the feet are below the heart as in sitting or standing. Many individuals suffer from vascular stasis and fluid accumulation (dependent edema) when standing or sitting for prolonged periods with the feet down (dependent), because this pumping action is absent for too long a period of time. Furthermore, patients confined to bed may suffer blood clots in the legs from inactivity. The instant invention further includes devices to monitor and encourage periodic motion of any particular body joint.

By encouraging periodic motion of a joint, the device can promote circulation, prevent vascular stasis, thrombosis and edema. In addition, such regular periodic motion can aid in healing of injury and prevent joint dysfunction from improper wound healing. This may be especially useful in the postoperative care following surgery involving a body joint such as in knee and hip joint replacement. When a wound heals, fibroblast cells lay down an amorphous matrix that consolidates into gradually enlarging and strengthening fibers. When there is no movement associated with the healing process, these fibers are randomly oriented as in a ball of cotton, and have little strength. By contrast, where the fibers are laid down while there is motion of the healing tissue, the fibers orient themselves in the direction of motion, forming a much stronger structure much as a fiber reenforced plastic with fibers oriented for greatest strength as used in advanced aircraft parts, fishing rods and golf clubs. Furthermore, after the initial laying down of fibers, there is a gradual shortening of the fibers that can lead to joint contracture and immobility. Periodic motion of the joint throughout the healing process can prevent this contracture. Current practice employs occasional physical therapy sessions where the requisite motion is encouraged. The instant invention can be applied to a specific amplitude and direction of motion of a particular joint to encourage this motion throughout the entire waking hours.

It is an object of the present invention to provide apparatus to encourage the requisite motion and to encourage the requisite periods of operation.

It is a further object to provide apparatus for encouraging periodic leg muscle actions that can be worn by the user for more convenience of operation than floor mounted apparatus of the prior art.

It is an object to provide a device that may be worn and used comfortably by a person confined to bed such as a postoperative patient to prevent vascular stasis and its complications.

It is a further object to provide apparatus to encourage the requisite motion and to encourage the requisite periods of operation that has substantially no moving parts.

The construction of the device of the invention in its preferred embodiments and the manner through which the desired results are secured will be best understood by reference to the accompanying drawings, wherein:

BRIEF DESCRIPTION OF THE DRAWINGS

FIG. 1 is a view of the invention in use with the shoe partially broken away to show the switch containing insole.

FIG. 2 is a plan view of the invention of FIG. 1 removed from the shoe and ankle of the user.

FIG. 3 is a schematic block diagram of the invention of FIGS. 1 and 2.

FIG. 4 shows another embodiment of the invention in use strapped to the outside of the shoe.

FIG. 5 is a plan view of the invention of FIG. 4.

FIG. 6 shows another embodiment of the invention embedded completely within an insole.

FIG. 7 shows another embodiment, partially broken away, of the invention incorporated into a shoe.

FIG. 8 shows another embodiment of the invention incorporated into a sleeve to be slipped over the pedal of a wheelchair.

FIG. 11 is a detail of a porton of device of FIG. 10 in cross section.

FIG. 14 shows another embodiment of the invention incorporated into a stocking.

BEST MODE FOR CARRYING OUT THE INVENTION AND INDUSTRIAL APPLICABILITY

Figure 9:
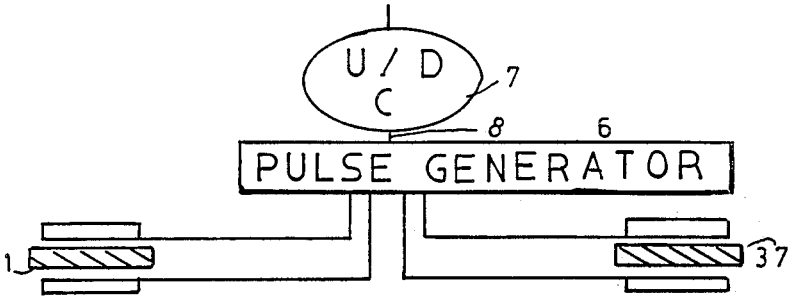
FIG. 9 shows a partial block diagram of an embodiment of the invention with two switch mechanisms.

Referring now to FIGS. 1, 2 and 3, switch mechanism 1 incorporated into insole 17 is worn in shoe 21. Switch 1 may be located forward at 31 in the insole so as to be responsive to forces applied by the ball 22 of the foot 28 or rearward at 32 in the insole so as to be responsive to forces applied by the heel 23, of the foot. Switch 1 connects to electronic module 18 by wire connection 5 which may be a flat resilient plastic laminate coextensive with insole 17 so as to fit comfortably along the side of the foot. The module 18 may be fastened to the ankle 27 by strap 19 with fasteners 34. Strap and module may also be incorporated into flat, resilient, plastic laminate coentensive with insole 17. Switch 1 is thin and flat in nature, such as a membrane switch, so as not to be obstructive or uncomfortable in use. By carefully laminating it into the insole, it may not be felt by the user. The switch type is exemplified by the membrane switches of Kynar TM, a piezoelectric polyvinylidine fluoride film by Pennwalt Corp. This plastic film 2 is sandwiched between metallic films 3, 4 which act as electrodes. When the film is compressed, a voltage is generated between electrodes 3 and 4. This small electrical signal is carried by connection 5 to pulse generator 6 which converts the signal into a discrete, countable electrical pulse which is fed to the down input 8 of UP/DOWN counter 7. Time pulser 10 receives 3000 cycles per second from oscillator 11. These are divided down to two countable pulses per minute and fed to UP input 9 of UP/DOWN counter 7 which is a preset counter set to 30. When a total of 30 UP counts have been accumulated from pulses input at input 9 from time pulser 10, a positive signal appears at output 12. This positive signal is fed to one of two inputs of AND circuit 13. Time pulser 10 has a second output 38 which sends two positive pulses per minute to the second input of the AND circuit 13. Therefore when counter 7 is at 30, a positive signal appears at the output of the AND circuit 13 twice a minute. This feeds through signal enable circuit 14 to enable signal driver 15 twice a minute which drives signal transducer 16 at 3000 c/s from oscillator 11. This produces a 3000 c/s signal twice a minute as long as counter 7 is at 30.

Every time switch 1 is actuated, the total count in counter 7 is reduced one count. Counter 7 is designed to never go above 30 or below zero. As long as switch 1 is actuated at least 30 times every fifteen minutes, the signal transducer will not disturb or notify the user. Signal transducer 16 may be a sonic transducer or a vibratory transducer applied to the body so that the signal is felt and not heard. Battery 33 powers the electronic circuitry through on/off switch 30. As shown in FIG. 2, the insole may be large enough to fil comfortably in a large shoe. The essential functional elements may be located centrally and marked by lines 20. A user may trim the insole to fit a smaller shoe, being cautioned not to cut beyond the marks 20.

Referring now to FIGS. 4 and 5, an embodiment of the invention intended to be strapped to the outside of the shoe is shown. The switch 1 is located beneath the shoe 21 and the electronic module 18 is located above the shoe. Strap 19 with fasteners 34 holds the assembly in place. The entire apparatus may be made into a monolithic assembly by embedment into a resilient plastic strap 19 such as a polyvinyl chloride or a polyurethane. In certain applications such as in hospital, the assembly may be strapped to the foot.

FIG. 6 illustrates an embodiment of the invention wherein the entire assembly is molded into a resilient plastic insole. It may be desirable to include and on/off switch to conserve batteries when not in use. On/off switches that can also be sealed in the plastic insole without protrusions would complement these applications. An on/off switch 30 may be thermally actuated from the body heat or pressure actuated from body weight. The signal transducer 16 would be more effective as a vibrator since the sound would be muffled by the shoe.

FIG. 7 shows an embodiment of the invention wherein the apparatus is molded into a shoe or overshoe with the switch 1 in the sole and the electronic module at the top of the shoe 21. The device may be molded into a portion of an overshoe to be slipped over the front of a shoe as indicated by the portion to the left of line 26.

FIG. 8 shows an embodiment of the invention wherein the apparatus of the invention is molded into a sleeve 35 to be slipped over a wheelchair pedal 36. The switch 1 would be atop the pedal to sense the force of the foot alternately pressing and relaxing. The electronic module 18 is shown beneath the pedal 36 where it will be protected from trauma.

Pedal mechanisms of the prior art required a certain amplitude of ankle flexing motion in order to register in the counting element of the reminder mechanism which ensured lower leg muscle contraction and relaxation sufficient to provide the requisite assistance to the blood circulation. The instant invention may be operated in a similar fashion by flexing the ankle. For example, a seated subject wearing the embodiment of FIG. 1 might alternately raise and lower the toe of the shoe, using the heel of the shoe as a fulcrum. However, the user would have to apply enough pressure when the toe is down to actuate switch 1 when it is under the ball of the foot. There is no built-in mechanism for ensuring that the user then raises his toe a particular amount. The user might register counts by alternately pressing down with the ball of the foot and then relaxing the pressure without actually lifting the foot at all.

In like manner, the device may be operated by a standing subject by alternately shifting weight from the ball of the foot to the heel. We have made the surprising discovery that, if these pressing and shifting actions are of sufficient intensity, they will involve great enough muscular contraction and relaxation to provide the supplemental vein/lymph pumping action necessary to prevent venous stasis such as is normally provided by walking motions. The user will soon learn the extent of muscular action necessary to overcome venous stasis. The invention will remind him of his need to perform those actions.

In another embodiment shown in FIG. 9, a partial block diagram, there are a pair of switch mechanism 1 and 37 both connected to pulse generator 6. In order for a count to appear at the DOWN input 8 of UP/DOWN counter 7, first switch 1 must be actuated and released and then switch 37 must be actuated and released. Switch 1 would be installed at the forward portion 32 of insole 17 shown in FIG. 2 and switch 37 would be installed at the rearward portion 31 of insole 17. In order for an action to count, first pressure must be applied to the ball of the foot and then the pressure must be transferred to the heel of the foot. In certain applications this embodiment may enhance compliance with a proper exercise regimen.

Figure 10:
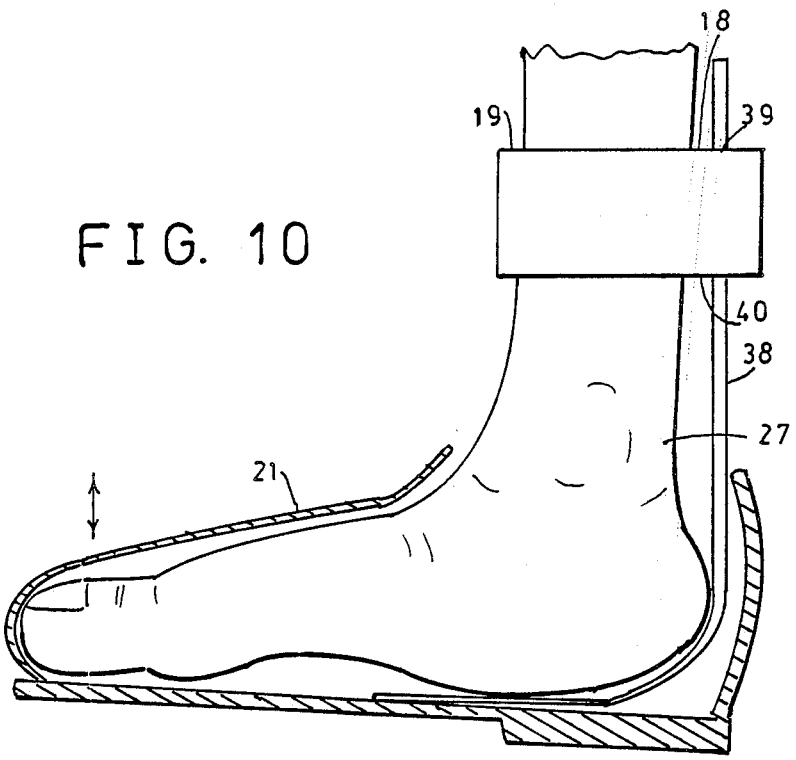
FIG. 10 is an elevation of another embodiment in partial cross section.

The embodiment of the invention illustrated in FIGS. 10 and 11 employs a thin, flexible (e.g. plastic) strip 38 that fits inside shoe 12, sock or slipper, and up along the back of the ankle 27. It is slidably retained within the four-sided channel 39 which is open at top and bottom for passage of the strip 38. A magnet 40 is embedded in the strip 38. As the ankle flexes, the strip moves up and down in the channel. The assembly 41 which incorporates the channel 39 is strapped to the ankle 27 by strap 19. Assembly 41 further includes electronic module 18 incorporating two magnetic reed switches 42 and 43. As the toe of the foot is raised and lowered by ankle action, the strip 38 and its magnet 40 are lowered and raised in channel 39, thereby actuating first switch 42 and then switch 43. The two switches are spaced sufficiently far apart that successive switch actuations require enough amplitude of ankle flexing and lower leg muscle activity as to ensure adequate pumping of the blood and lymph in the lower limb for the purpose of overcoming vascular stasis. Other switches well known in the art may substitute for magnetic switches.

Figure 12:
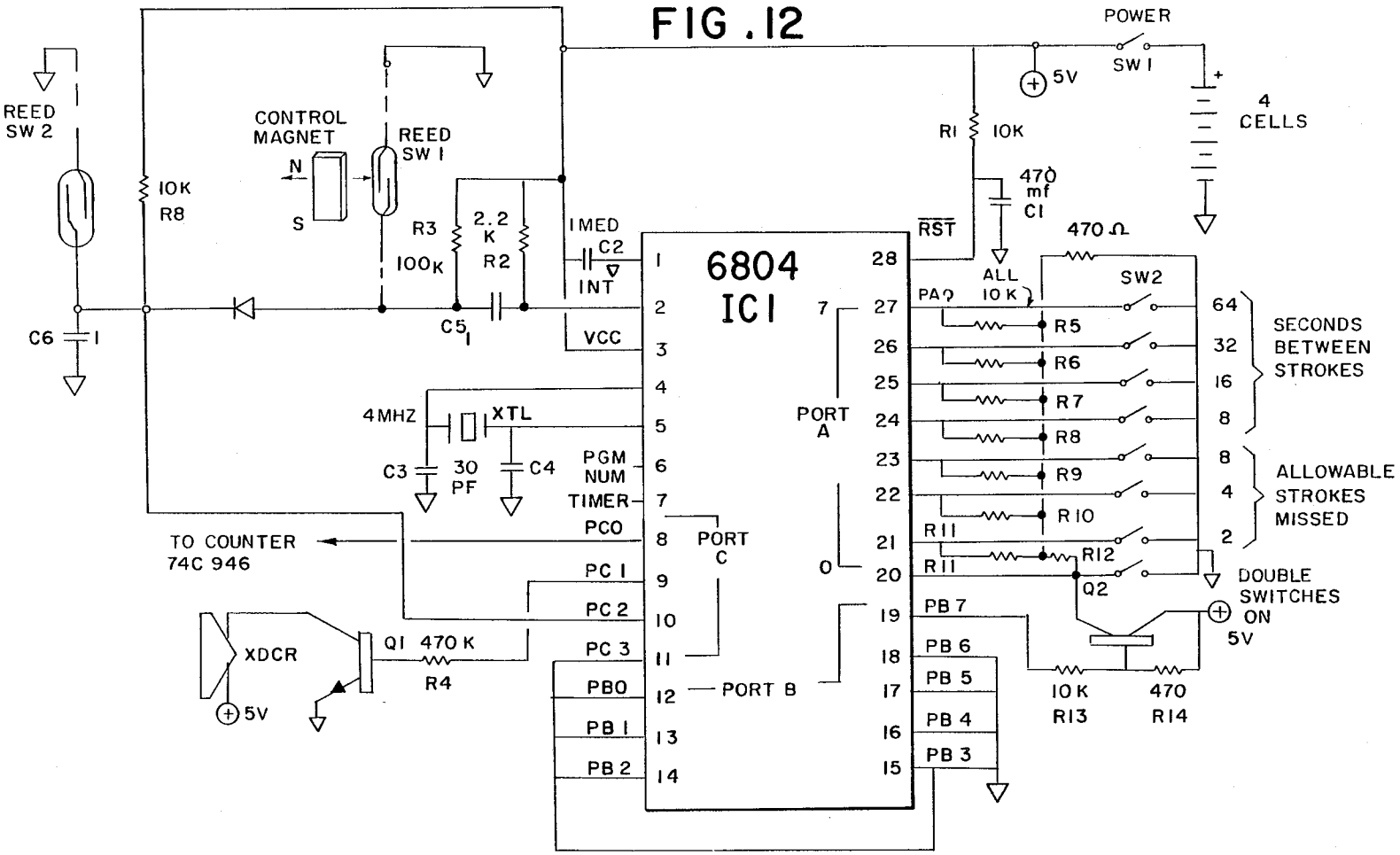
FIG. 12 is a schematic diagram of the electronic module.

The electronic module 18 operates in a manner similar to that described above for the device of FIG. 9 wherein two separate signals must be received to count as a stroke. The schematic diagram of FIG. 12 illustrates the use of an integrated circuit chip incorporating a microcomputer integrated circuit 5 in the electronic module 18. The multipolar switch SW 2 can be actuated to change the number of required strokes accumulated per time unit and also the total number of strokes to begin signalling.

The switch can also select the requirement of a single switch or two-switch actuation to count as a stroke.

Figure 13:
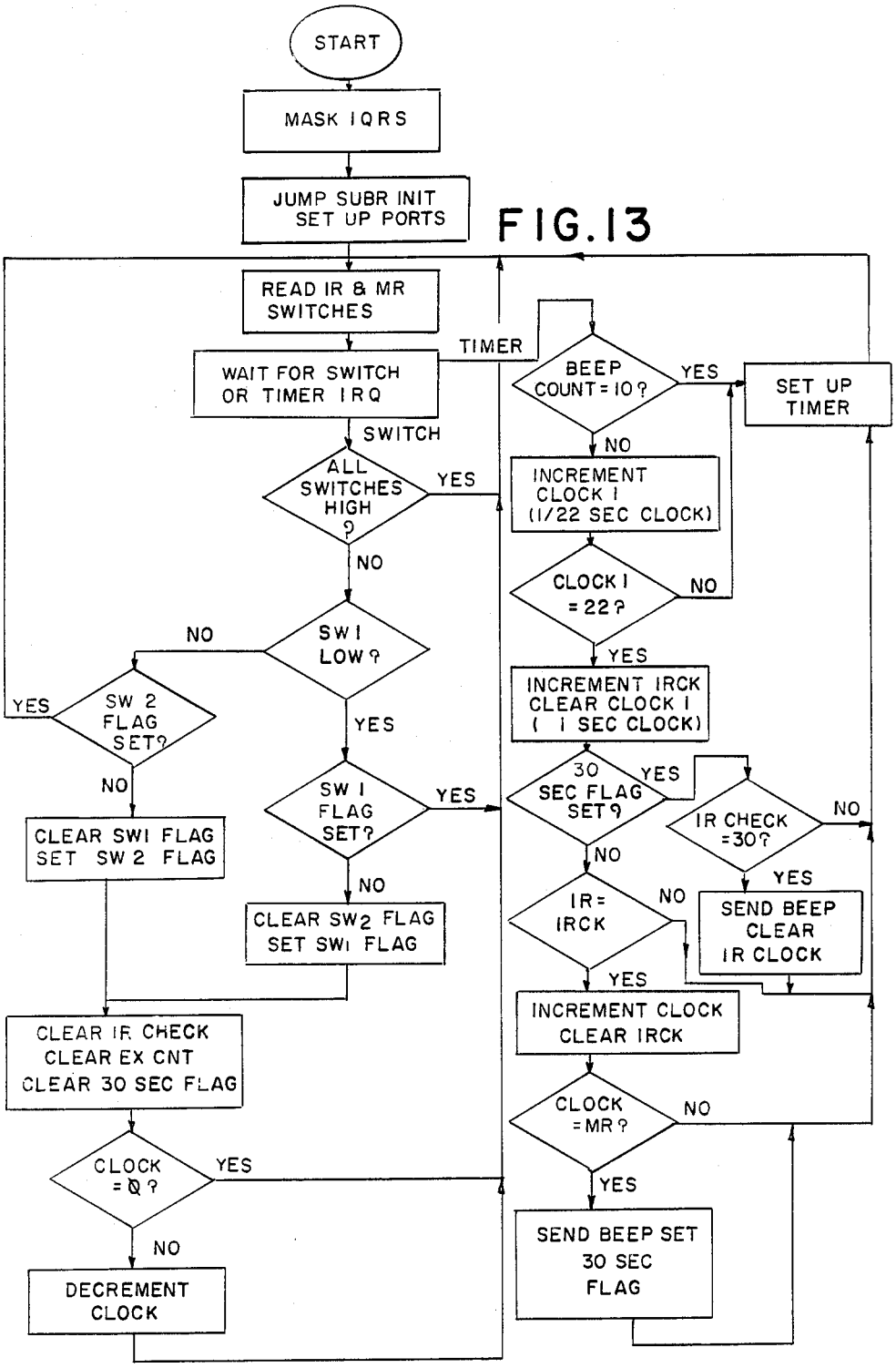
FIG. 13 is a flow chart of the program in the module of FIG. 12.

FIG. 13 is a flow chart of the program incorporated in the microcomputer of FIG. 12. It has, in addition to the stroke up/down counting features, the option to count and display the number of strokes that were required, but not made. It further includes a program to turn off the audible signal after five minutes of signalling without response. This reduces the battery load, avoids the need for an on/off switch, and permits the user to sleep undisturbed in the application for a patient confined to bed.

Figure 15:
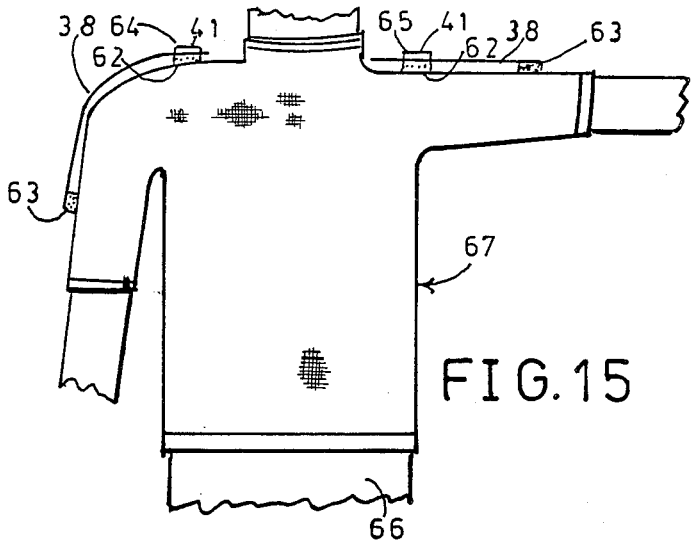
FIG. 15 shows diagrammatically the invention applied to both shoulders to monitor and encourage motion of the shoulder joints.

In the embodiment of the invention shown in FIG. 14, the electronic module 45 is attached to stocking 44 at attachment 46. Incorporated with the electronic module is a channel 39 for the flexible plastic strip 38 carrying the magnet. The strip 38 is attached at attachment 44 to the heel of the stocking. Flexing the ankle causes the magnet on the strip to move up and down in the channel, actuating the two switches as described for FIG. 10 and 11. This model is useful in bed patients and airline passengers and those who stand for prolonged periods. The device is shown applied to both shoulders in FIG. 15 to monitor the motion of the shoulder joints. On the torso 66 is worn the snug fitting T-shirt 67. Attached to the shoulder portion of the garment are devices 64 and 65 of the invention. Details of the device are shown in cross section in FIG. 11. Thin flexible plastic strip 38 is attached to the garment 67 at 63. The strip 38 slides through a channel 39 in module 41. It carries a magnet 40. Module 41 is also attached to the garment at 62. These attachments may be a Velcro-type fastening for easy changing. It can be seen that when strip 38 is bent with the joint as at 64, the magnet is pulled toward 63 and when the joint is straightened as at 65, the magnet is pushed in the opposite direction past the switches. Assembly 41 further includes electronic module 18 incorporating two magnetic reed switches 42 and 43. As the arm is raised and lowered by shoulder action, the strip 38 and its magnet 40 are lowered and raised in channel 39, thereby actuating first switch 42 and then switch 43. The two switches are spaced sufficiently far apart that successive switch actuations require enough amplitude of joint flexing to ensure adequate motion for healing and the purpose of overcoming vascular stasis.

Figure 16:
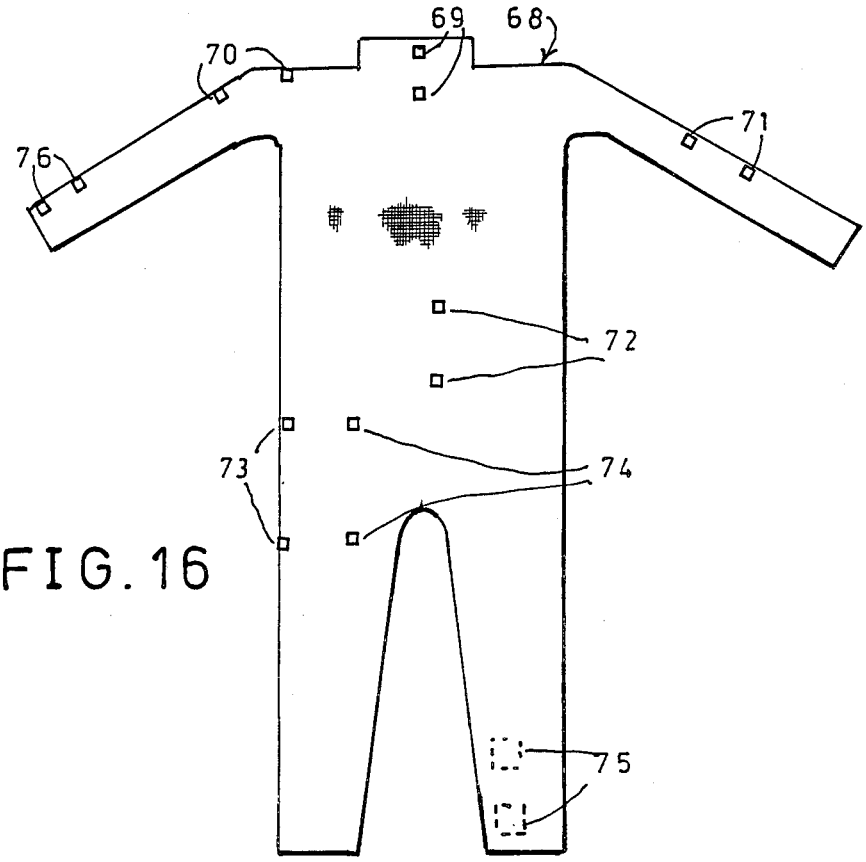
FIG. 16 shows a body stocking with a plurality of attaching means for attaching the device for monitoring and encouraging the motion of a plurality of body joints.

To increase the versatility of the invention by making a single device suitable for a number of different applications, the device made with hook and loop fasteners at 62 and 63 of FIG. 11 may be applied to a number of different body sites as illustrated by the body stocking 68 of FIG. 16 including attachment sites for the device at the following joints; neck 69, elbow 71, shoulder 70, wrist 76, back 72, knee 75, and two positions 73 and 74 on the hip for different motion directions.

Because the invention is subject to many variations, modifications and changes in detail, it is intended that all matter described above be interpreted as illustrative and not in a limiting sense.

What is claimed is:

1. A device for encouraging periodic relative motions between a first body part and a second body part joined by a body joint to prevent certain pathologic processes from the group including vascular stasis, edema, and joint dysfunction, comprising:

timing count generating means for generating discrete required counts at discrete count intervals;

switch means responsive to at least a predetermined amplitude of flexing motion of said joint, the frequency and amplitude of said motion acting to prevent said pathologic processes;

action count generating means connected to said switch means for generating discrete action counts in response to responses of said switch means;

up/down counter means connected to said timing count generating means and to said action count generating means for accumulating said required counts in a timing count accumulation in a first direction of counting and for reducing said timing count accumulation by said action counts in a second and opposite direction of counting;

preset count means, connected to said up/down counter means, responsive with an output signal when said required counts have accumulated to a preset number of counts;

signal means connected to said preset count means and responsive to said output signal of said preset count means by a signal perceptible to said person to remind said person to provide a sufficient number of said motions to reduce said required count accumulation and thereby stop said perceptible signal, wherein said switch means is unresponsive to motion below a preset amplitude of motion so as to ensure said motions applying sufficient activity to prevent said pathologic processes.

2. The invention of claim 1, including counting and display means connected to said preset count means for displaying information related to the number of said action counts that were required and not performed.

3. The invention of claim 1, further comprising:

elongate flexible actuator means having a first end which is moved in concert with the surface of said first body part and a second end having switch actuating means, said second end disposed to move freely in a to and fro motion under the forces applied by said first end during said motion;

and said switch means is moved in concert with said second body part, said switch means disposed so as to be actuated by said switch actuating means in said to and fro motion only when said motion exceeds said predetermined amplitude.

4. In the invention of claim 3, said switch means including two switching means placed apart from one another along the path of travel of said switch actuating means so that a first one of said switching means is actuated by said switch actuating means at a first angular position of said joint and a second one of said switching means is actuated at a second angular position of said joint by said switch actuating means, and said switch means is only responsive to the successive actuation of both of said switching means.

5. In the invention of claim 4, said switch actuating means including magnet means and said switching means including magnetically actuated switching means.

6. In the invention of claim 3, said first end of said actuator means is adapted to attach to covering means covering said first body part and said second end is disposed to slide in a channel means, said channel means moving in concert with said switch means, said channel means adapted to attach to covering means covering said second body part.

7. The invention of claim 6, including flexible body covering means, said body covering means adapted for covering said first body part and second body part and said joint therebetween, said covering means including first attaching means for attaching to said first end of said actuator means, and a second attaching means for attaching to said channel means.

8. In the invention of claim 7, said covering means including a plurality of attaching means for monitoring a plurality of body joints.

9. A device for encouraging periodic leg muscle action to prevent vascular stasis of the foot and leg of a person, comprising: timing count generating means for generating discrete required counts at discrete time intervals; switch means responsive to a change of pressure applied by said foot to said switch means through a muscle action; action count generating means connected to said switch means for generating discrete action counts in response to responses of said switch means;

up/down counter means connected to said timing count generating means and said action generating means for accumlating said required counts in a required count accumulation in a first direction of counting and for reducing said count accumulation by said action counts in a second and opposite direction of counting;

preset count means, connected to said up/down counter means, responsive with an output signal when said required counts have accumulated to a preset number of counts;

signal means connected to said preset count means and responsive to said output signal of said preset count means by a perceptible signal to said person to remind said person to provide enough of said muscle actions to reduce said required count accumulation and thereby stop said perceptible signal, wherein said muscle actions apply alternating compression and relaxation forces to the circulatory system of the limb to enhance its circulation.

10. The device of claim 1, said perceptible signal including audible signal means.

11. The device of claim 1, said perceptible signal including vibratory signal means adapted to be felt by said person.

12. The device of claim 1, said switch means including a first switch means responsive to pressure from a first region of said foot, and a second switch means responsive to pressure from a second region of said foot; and said action count generating means which responds with an action count only upon receiving responses from both of said switch means in sequence to ensure a particular type of muscular action by said person.

13. In the device of claim 1, said switch means including piezoelectric membrane.

14. In the device of claim 1, said switch means is embedded in an insole means.

15. The invention of claim 14 wherein, said switch means embedded in said insole is connected to the signal means of said device which is connected to a strap adapted to be worn around the lower leg of said person.

16. The device of claim 1, completely embedded in an insole.

17. The device of claim 1 including an on/off switch actuated by body heat.

18. The device of claim 1 including an on/off switch actuated by body pressure.

19. The device of claim 1 embedded in a shoe.

20. The device of claim 1 incorporated into a sleeve means adapted for slipping over the pedal of a wheelchair.

21. A device for encouraging periodic leg muscle action to prevent vascular stasis of the foot and leg of a person, comprising:

timing count generating means for generating discrete required counts at discrete count intervals;

switch means responsive to at least a predetermined amplitude of flexing motion of the ankle joint of said person, said amplitude of motion ensuring said muscle action;

action count generating means connected to said switch means for generating discrete action counts in response to responses of said switch means;

up/down counter means connected to said timing count generating means and to said action count generating means for accumulating said required counts in a timing count accumulation in a first direction of counting and for reducing said timing count accumulation by said action counts in a second and opposite direction of counting;

preset count means, connected to said up/down counter means, responsive with an output signal when said required counts have accumulated to a preset number of counts;

signal means connected to said preset count means and responsive to said output signal of said preset count means by a signal perceptible to said person to remind said person to provide a sufficient number of said muscle actions to reduce said required count accumulation and thereby stop said perceptible signal, wherein said switch means is adapted to be unresponsive to ankle motion below a preset amplitude of motion so as to ensure said muscle actions applying sufficient compression and relaxation forces to the circulatory system of the limb to enhance circulation.

22. In the invention of claim 21, said switch means including:

elongate, flexible actuator means having a first end adapted to move in concert with the surface of the heel of said foot, and a second end having switch actuating means, said second end adapted to move freely along the back of said leg in a caudal direction when said foot is dorsi-flexing and in a rostral direction when said foot is plantar-flexing, said second end moving under the forces applied by said first end; electrical switch means which is actuated by said switch actuating means only when said ankle motion has exceeded a preset amplitude.

23. In the invention of claim 22, said electrical switch means including two switches placed apart from one another along the path of travel of said switch actuating means so that a first one of said switches is actuated by said switch actuating means at a first angular position of said foot and a second one of said switches is actuated at a second angular position of said foot by said switch actuating means, and said switch means is only responsive to the successive actuation of both switches.

24. The invention of claim 23, wherein said actuator means is a strip, said first end of said actuator means is adapted to fit inside a foot covering and said second end is adapted to slide in a channel means containing said switch means, said channel means adapted to be attached to said leg in such fashion as to remain substantially stationary when said ankle is flexed.

25. The invention of claim 24, wherein said switch actuating means includes magnet means and said electrical switch means are magnetically actuated switch means.

26. The invention of claim 22, including stocking means, wherein said first end of said actuator means is attached to the heel portion of said stocking means and said switch means is attached to the leg portion of said stocking means.

27. The invention of claim 21, further comprising counting and display means connected to said preset count means for displaying information related to the number of said action counts that were required and not performed.

* * * * *